US007779492B2

(12) United States Patent
Mangano

(10) Patent No.: US 7,779,492 B2
(45) Date of Patent: Aug. 24, 2010

(54) SELF-STORING COMBINATION BLANKET AND NECK ROLL ASSEMBLY

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 0 days.

(21) Appl. No.: 12/315,875

(22) Filed: Dec. 5, 2008

(65) Prior Publication Data

US 2010/0139001 A1 Jun. 10, 2010

(51) Int. Cl.
*A47C 31/00* (2006.01)

(52) U.S. Cl. ..... 5/482; 5/419; 5/417

(58) Field of Classification Search ..... 5/419–420, 5/417, 482; 297/219.1
See application file for complete search history.

(56) References Cited

U.S. PATENT DOCUMENTS

| | | | |
|---|---|---|---|
| 310,309 | A | 1/1885 | Pick |
| 750,735 | A | 1/1904 | Turck |
| 1,051,566 | A | 1/1913 | Dreher |
| 1,538,538 | A | 5/1925 | Wood |
| 1,930,942 | A | 10/1933 | Pringle |
| 2,413,828 | A | 1/1947 | Hirsh et al. |
| 2,420,344 | A | 5/1947 | Alexander |
| 2,652,183 | A | 9/1953 | Hlivka |
| 4,101,994 | A | 7/1978 | Hoyt |
| 4,195,378 | A | 4/1980 | Parker |
| 4,273,380 | A | 6/1981 | Silvestri |
| D268,976 | S | 5/1983 | Ross |
| 4,428,368 | A | 1/1984 | Torii |
| D280,170 | S | 8/1985 | Short |
| 4,546,507 | A | 10/1985 | Weinstein |
| 4,656,670 | A | 4/1987 | Schluter |
| 4,676,376 | A | 6/1987 | Keiswetter |
| 4,687,248 | A | 8/1987 | Ross et al. |
| 4,694,511 | A | 9/1987 | Estes et al. |
| 4,789,247 | A | 12/1988 | Schnoor |
| 4,872,229 | A | 10/1989 | Brady |
| 4,878,489 | A | 11/1989 | Kamayachi |
| 4,935,972 | A | 6/1990 | Brady |

(Continued)

FOREIGN PATENT DOCUMENTS

| | | |
|---|---|---|
| BE | 8900220 | 7/1991 |

(Continued)

*Primary Examiner*—Fredrick Conley
(74) *Attorney, Agent, or Firm*—Galgano & Associates PLLC; Thomas M. Galgano; Jessica G. Bower

(57) ABSTRACT

A self-storing combination blanket and neck roll assembly which can be draped over a person and supported on a seat back, having a flat, generally rectangular fabric panel with two sides and four side edges, a flexible neck roll centrally located and removably disposed adjacent to a portion of the fabric panel, disposed adjacent to one of the side edges and a pouch having an opening which is attached to a side edge of the fabric panel adjacent to the neck roll so that the opening of the pouch opens towards one of the sides of the fabric panel. The fabric panel and neck roll are movable between a folded stored position within the pouch and an open position disposed exteriorly of the pouch. When the assembly is in its open position, the opening of the pouch can be received over and atop of a seat back.

37 Claims, 11 Drawing Sheets

U.S. PATENT DOCUMENTS 4,958,628 A 9/1990 Iwamoto et al.
4,969,683 A 11/1990 Wallace et al.
4,980,935 A 1/1991 Kazanowski et al.
4,993,090 A 2/1991 Ranalli
5,005,901 A 4/1991 Hinde
5,081,727 A 1/1992 Ippolito
5,110,219 A 5/1992 Lopes
5,150,945 A 9/1992 Aupperlee et al.
5,167,227 A 12/1992 Meserlian
5,193,528 A 3/1993 Iwamoto et al.
5,199,120 A 4/1993 Holmes
5,243,724 A 9/1993 Barnes
D341,513 S 11/1993 Reeves et al.
5,344,437 A 9/1994 Pistay
5,374,238 A 12/1994 Xiao
5,383,842 A 1/1995 Bertini
5,437,061 A 8/1995 Kenner
5,463,783 A 11/1995 Pope
D366,177 S 1/1996 Dean
5,545,199 A 8/1996 Hudson
5,587,219 A 12/1996 Schofield
5,609,566 A 3/1997 Pupovic
5,611,095 A 3/1997 Schneider
5,662,380 A 9/1997 Tam et al.
5,707,107 A 1/1998 Melone
5,736,213 A 4/1998 Meier
5,781,946 A 7/1998 McEntire et al.
5,806,925 A 9/1998 Hanley
5,850,643 A 12/1998 Brumfield
5,875,492 A 3/1999 Moss
5,884,331 A 3/1999 Barajas
5,918,933 A 7/1999 Hutchinson et al.
5,920,931 A 7/1999 Zuehlke et al.
5,950,261 A 9/1999 Hay et al.
5,988,744 A 11/1999 Franchak
6,012,189 A 1/2000 Dudley
6,048,026 A 4/2000 Barnett et al.
6,145,932 A 11/2000 Hamel-Nyhus et al.
6,243,873 B1 6/2001 Aliff
6,332,873 B1 12/2001 Naruse et al.
6,353,933 B1 3/2002 Love
6,394,543 B1 5/2002 Dunne et al.
6,643,870 B2 11/2003 Bertrand
6,647,570 B1 11/2003 Ong
6,658,681 B2 * 12/2003 Britto et al. ..... 5/655
6,760,921 B1 7/2004 Simmons
6,764,134 B1 * 7/2004 Crescenzi et al. ..... 297/219.12
6,764,214 B2 7/2004 Shukla et al.
6,851,127 B1 2/2005 Khan
6,929,612 B2 8/2005 Mangano
6,966,069 B2 11/2005 Booth
7,003,825 B1 2/2006 Levings
7,058,997 B1 6/2006 Klinger
7,076,816 B1 7/2006 Nielsen et al.
7,175,231 B2 2/2007 Gallo
7,178,185 B1 2/2007 Nattler
7,225,483 B1 6/2007 Remblad
7,231,677 B1 * 6/2007 Reeves ..... 5/419
2001/0044964 A1 11/2001 Phillips
2002/0129445 A1 9/2002 Deering et al.
2002/0169398 A1 11/2002 Hancock
2002/0198476 A1 12/2002 Chen
2003/0061659 A1 4/2003 Dunlap et al.
2004/0107500 A1 6/2004 Pigg
2004/0255357 A1 12/2004 Erickson
2005/0085749 A1 4/2005 Baerwalde et al.
2005/0262634 A1 12/2005 Gottlieb
2005/0283910 A1 12/2005 DuQue
2006/0037139 A1 2/2006 Akkad
2007/0130693 A1 6/2007 Theriault
2008/0030056 A1 2/2008 Bentley et al.
2008/0066229 A1 3/2008 Auer et al.
2008/0127414 A1 6/2008 Allen
2008/0216238 A1 9/2008 Tatsuno

FOREIGN PATENT DOCUMENTS

DE 8815766 12/1988
GB 2232083 A 12/1990

* cited by examiner

SELF-STORING COMBINATION BLANKET AND NECK ROLL ASSEMBLY

BACKGROUND OF THE INVENTION

1. Field of the Invention

The invention relates to a combination blanket and neck roll assembly. More particularly, the invention relates to a self-storing blanket and attached neck roll which can be draped over a person and/or supported on a seat, particularly on the seat of an aircraft.

2. Brief Description of the Prior Art

Every year many people travel via means of public transportation, whether it is airplanes, buses, trains, ferries, or the like. Furthermore, many travelers frequently travel in their own personal vehicles. Comfort while traveling, particularly when traveling for extended periods of time, may be difficult to achieve. Many travelers like to rest and/or sleep while traveling but often find it difficult to do so as the seats are often uncomfortable, they cannot retain their head in a comfortable position to sleep, and they have no control over the environmental conditions, such as temperature. Therefore, travel is often displeasing and not restful.

It is advantageous to have a pillow and a blanket while traveling and also while at home, to provide comfort and warmth. While some airlines or other means of public transportation provide blankets and/or pillows, there is often a limited supply and the sanitary condition are questionable. These pillows and blankets are typically reused by multiple travelers and it is not certain whether they are cleaned between usages. Furthermore, as airlines and other means of public transportation are cutting costs, amenities such as pillows and blankets are being eliminated or are provided for purchase at a fee. Therefore, it is more economical, sanitary, easier and more comforting for a person to have their own personal pillow and blanket for use during travel. Furthermore, it is beneficial to have a versatile pillow and blanket which can be used while traveling but also at home, for example, while watching t.v., reading, sitting on a couch or chair, or while in bed.

However, even if a person does have their own pillow, it is often difficult to find a comfortable place to prop up the pillow to retain one's head in a comfortable position on an airline or other vehicle. Even if a comfortable position is achieved, it is often difficult to retain a conventional pillow in the desired position in relation to one's head, as the person's head or the pillow itself may shift during sleep or due to movement of the aircraft or vehicle. For example, a traveler may find that their head shifts or tilts to the side while they are asleep, causing neck strain and discomfort.

Therefore, it is advantageous to have a support for one's neck and head which retains them in a comfortable position for resting or sleeping and which also maintains its position in relation to the person. Moreover, a traveler may find that their blanket slips off of them due to shifting while sleeping or movement of the aircraft or vehicle and it is beneficial to have a blanket that will also stay in the position desired by the person. Furthermore, since public transportation providers typically have restrictions on the amount of luggage a person may carry-on, it is advantageous to have a blanket and neck roll which can be easily transported during travel and conveniently stored when not in use.

The prior art discloses many different types of blankets or towels having an attached pouch or pocket which allows the blanket to be folded and stored therein. Moreover, the prior art discloses many different types of covers for seats which are adapted to extend over the top of the seat back and are used to cover the seat itself. Certain of the prior art also discloses covers for seats which can also be wrapped around a person and worn by the person.

However, so far as is known, none of the prior art devices resolve all of these problems in a simple, effective and yet highly advantageous manner as does the present invention discussed herein.

SUMMARY OF THE INVENTION

It is therefore an object of the invention to provide a novel self-storing combination blanket and neck roll assembly.

It is another object of the invention to provide a self-storing combination blanket and neck roll assembly which has a relatively simple construction.

It is another object of the invention to provide a self-storing combination blanket and neck roll assembly which can be draped over a person to provide comfort and warmth.

It is another object of the invention to provide a self-storing combination blanket and neck roll assembly which can be supported on a seat back, particularly atop the back of an airline seat.

It is yet another object of the invention to provide a self-storing combination blanket and neck roll assembly having a neck roll to provide head and neck support for a person.

It is another object of the invention to provide a self-storing combination blanket and neck roll assembly having a neck roll which is bendable into a desired shape and retains the bent shape.

It is another object of the invention to provide a self-storing combination blanket and neck roll assembly which is able to fold and be stored within an attached pouch.

It is yet another object of the invention to provide a self-storing combination blanket and neck roll assembly which has a removable neck roll to allow for washing of the blanket.

Certain of the foregoing and related objects are readily attained according to the present invention by the provision of a self-storing combination blanket and neck roll assembly which can be draped over a person and supported on a seat having a back, preferably an airline seat, comprising, a flat, generally rectangular fabric panel having two sides and four side edges, a flexible neck roll centrally located and removably disposed adjacent to a portion of said fabric panel, disposed adjacent to one of said side edges of said fabric panel, and a pouch having an opening, said pouch being attached to said one side edge of said fabric panel adjacent to said neck roll so that said opening thereof opens towards one of said sides of said fabric panel. The fabric panel and neck roll are movable between a folded stored position within the pouch and an open position disposed exteriorly of the pouch and when in said open position, the opening of said pouch can be received over and atop of the seat back.

Preferably, the assembly further comprises an elongated tubular sleeve having two ends, one of which is open and the other of which is closed, thereby forming a neck roll-receiving pocket. The sleeve and, in turn, the pocket are disposed adjacent to a portion of said fabric panel adjacent to said opening of said pouch and the neck roll is removably disposed in said neck roll-receiving pocket. In a preferred embodiment, one of said sides of said fabric panel defines a side edge portion thereof extending along and adjacent to, and merging with said one of said side edges of said fabric panel and wherein a generally rectangular central section of said side edge portion is folded towards said at least one side of said fabric panel to define a flap having a flap edge coincident with and defined by said one side edge of said fabric panel and two flap ends, wherein said flap edge and one of said flap ends is attached to said fabric panel to form said elongated tubular sleeve from said fabric panel itself.

Desirably, the assembly further comprises means for removably securing said neck roll within said neck roll-receiving pocket which comprises a pair of hook and loop fasteners disposed adjacent to said open end of said elongated tubular sleeve, one of which fasteners is secured to said flap and the other of which is secured to said fabric panel opposite therefrom.

Advantageously, the four side edges of said fabric panel define four corners of said fabric panel, and wherein the two corners closest to said neck roll are each provided with an accessory pocket.

In a further preferred embodiment, the neck roll is made of a resilient material and is bendable into a desired bent shape. The neck roll has means for retaining said bent shape which desirably comprises a flexible spine disposed within said neck roll. In a particularly preferred embodiment, the neck roll comprises a tube and the flexible spine is an articulated spine extending axially along the majority of the tube. The spine advantageously comprises a multiplicity of successively-arranged, jointed rigid elements which are movable relative to one another by manual manipulation of the neck roll and, in turn, said spine thereof, to effect bending of said neck roll. The rigid elements are preferably joined to adjacent rigid elements by a ball and socket joint. Most desirably, the articulated spine extends substantially the entire length of said tube but is spaced from the ends thereof and the foam tube is continuous and encases the entire length of said spine. The articulated spine can be made of plastic and the tube made of a foam material. Optionally, the assembly further comprises a sleeve covering said foam tube. For practical considerations, the length of said neck roll may be less than the length of said pouch and the neck roll-receiving pocket may have a length which is slightly greater than the length of said neck roll.

In yet a further preferred embodiment, the pouch comprises two flat, generally rectangular sheets each having a top edge, a bottom edge, and two opposite side edges. The sheets are attached to each other along said top edges and said two side edges thereof and unattached along said bottom edges thereof to define said pouch opening and wherein said bottom edge of one of said sheets is attached to said one side edge of said fabric panel adjacent to said neck roll-receiving pocket.

Advantageously, the assembly also has means for removably securing the fabric panel and neck roll in said folded stored position within said pouch, comprising a mechanical fastener comprising a button and a loop, one of which is attached to one of said two sheets of said pouch, adjacent said pouch opening, and the other of which is attached adjacent to the other of said sheets, opposite therefrom.

Additional objects and advantages of invention will become apparent to those skilled in the art upon reference to the detailed description taken in conjunction with the provided figures.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
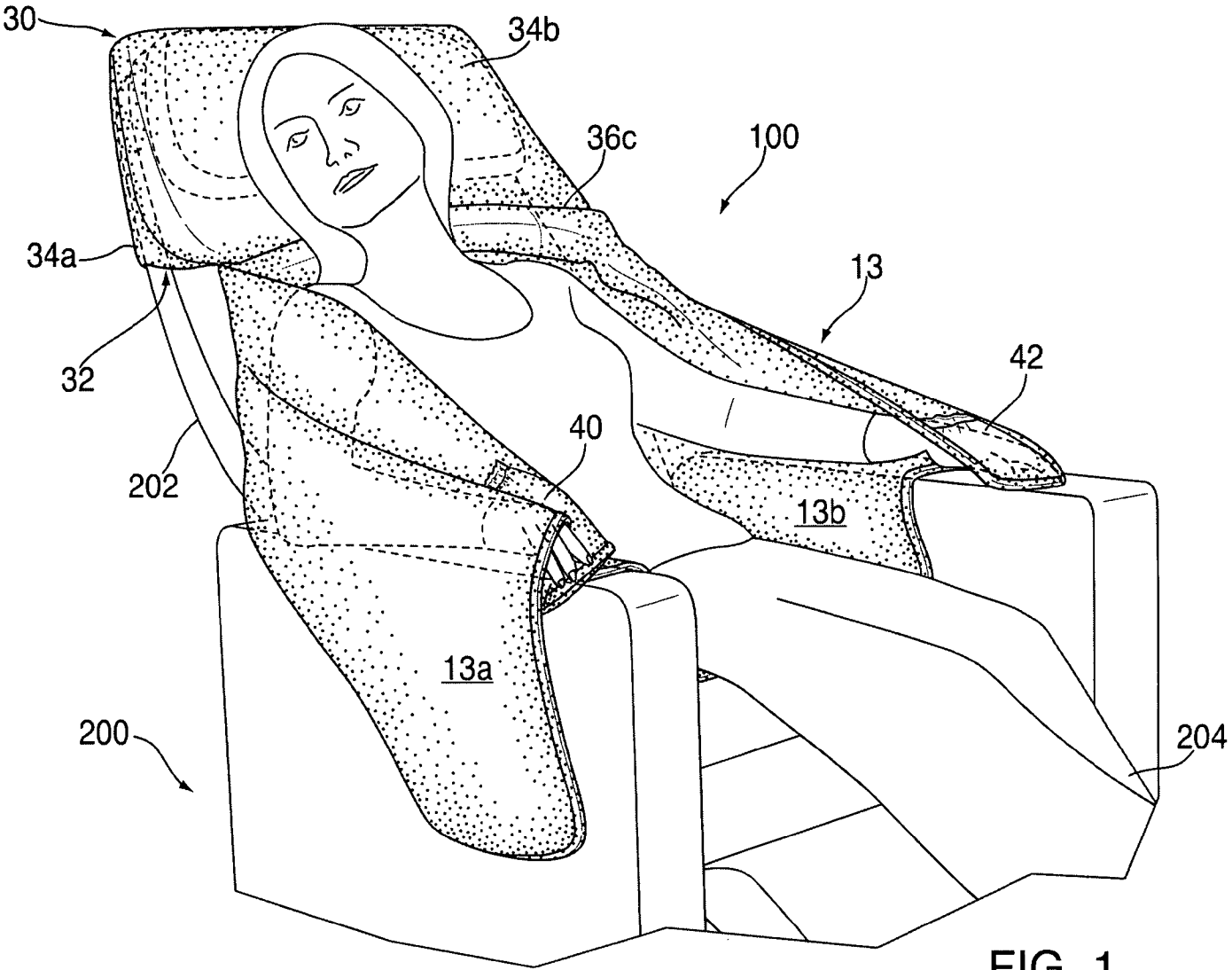
FIG. 1 is a perspective view of the self-storing combination blanket and neck roll assembly supported on a seat with the pouch opening received over and atop of the seat back and the blanket draped over a person.

Turning now in detail to the drawings and, in particular, FIG. 1 thereof, therein illustrated is a novel self-storing combination blanket and neck roll assembly according to the invention, generally designated by reference numeral 100, which is intended to be draped over a person 204 and supported on a seat generally designated by reference numeral 200. Assembly 100 includes a fabric panel generally designated by reference numeral 13, which is attached to a single pouch generally designated by reference numeral 30, which is received atop of a seat back 202, and a neck roll (not viewable) adjacent the pouch for supporting the person's neck and head.

Figure 2:
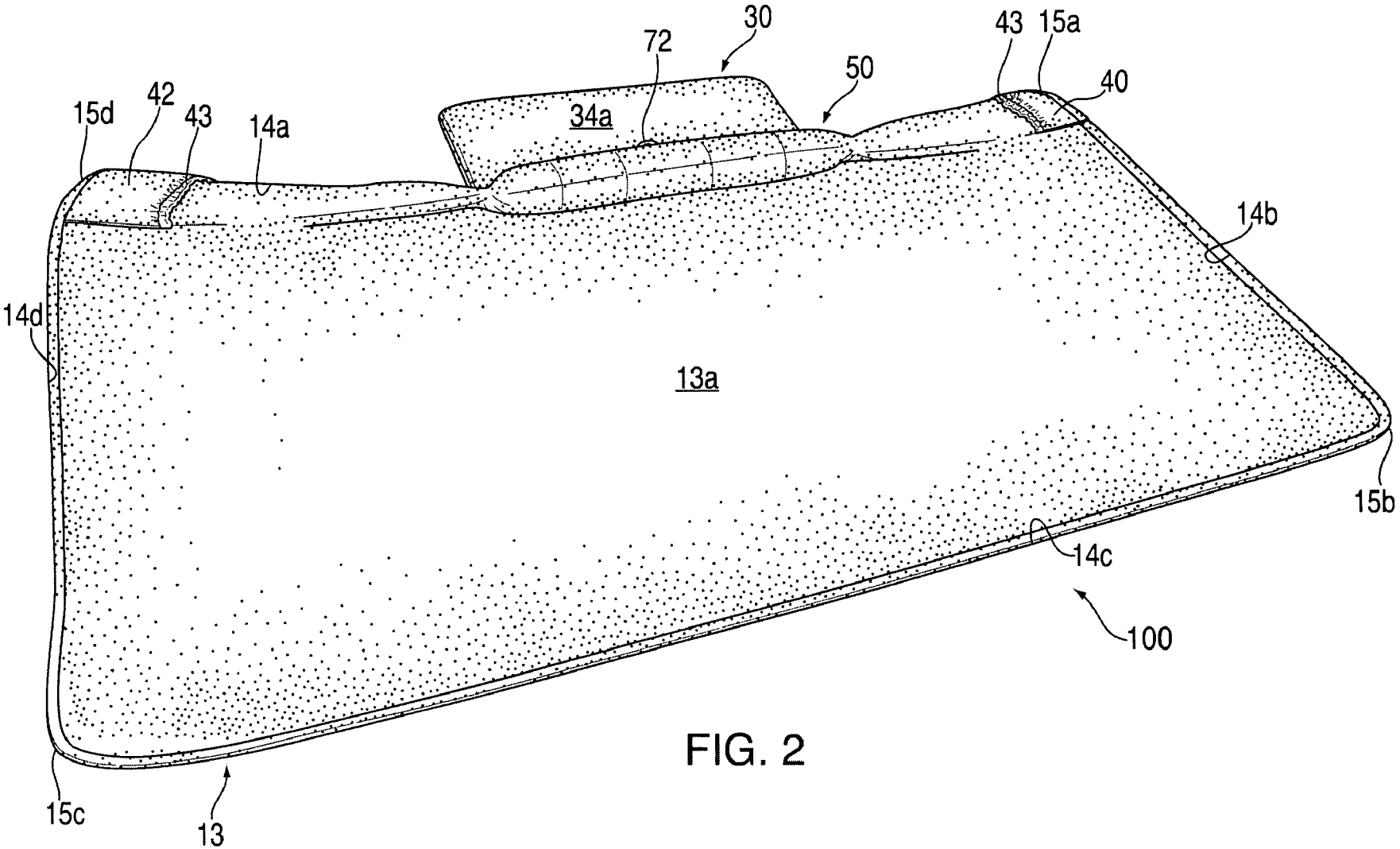
FIG. 2 is a front and side perspective view of the self-storing combination blanket and neck roll assembly according to the invention.

As shown in FIG. 2, fabric panel 13 is flat, generally rectangular and has two opposite sides 13*a* and 13*b* and four side edges 14*a*, 14*b*, 14*c* and 14*d* which, in turn, define four corners 15*a*, 15*b*, 15*c* and 15*d*. The fabric panel 13 is formed from two sheets of fabric stitched together along their respective side edges 14*a*-14*d* and corners 15*a*-15*d* to provide a continuous edge around the perimeter of the fabric panel 13.

The fabric panel 13 serves as a blanket which can be draped or wrapped around the person, to provide comfort and warmth, particularly when traveling, such as on an aircraft, but can also be used at home or any other place desired by the person. Fabric panel 13 is preferably made from a washable, soft fabric material but can be constructed from many different types of fabrics.

Two accessory pockets 40 and 42 are formed on side 13*a* of the fabric panel adjacent the corners 15*a* and 15*d*, respectively, and can be used to retain objects such as a book, phone, remote control, portable music players, eyeglasses, tissues etc. or for placement of the person's hands to keep them warm. Pockets 40 and 42 include elastic bands 43 along the opening of the respective pockets to retain the objects placed therein. It can be appreciated that the pockets can also be formed on the opposite side of the fabric panel.

Figure 3C:
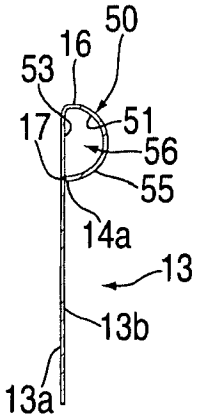
FIG. 3*c* is a cross sectional view along line 3*c*-3*c* of FIG. 3*b;*
Figure 3B:
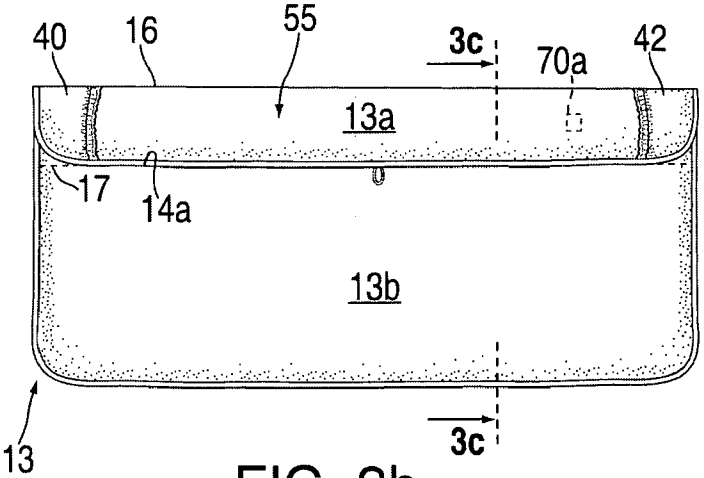
FIGS. 3*a*, 3*b* and 3*d* are rear elevational views showing the preferred steps of folding and stitching the fabric panel to itself to form the neck roll-receiving pocket.
Figure 3A:
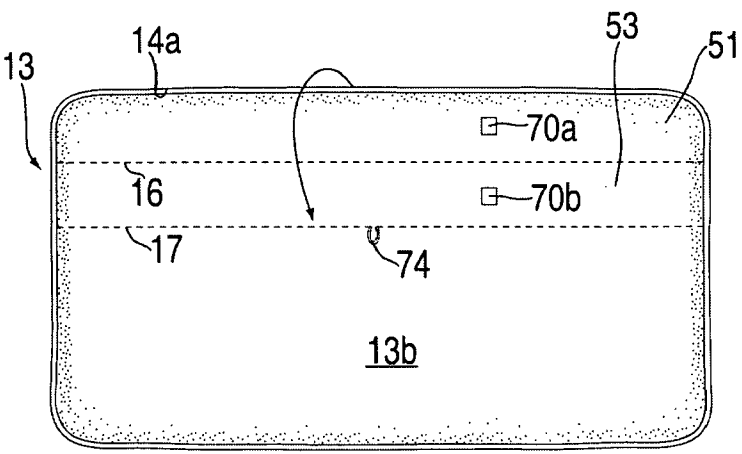

An elongated tubular sleeve generally designated by reference numeral 50 is disposed adjacent to side edge 14*a* and is formed by fabric panel 13 according to the steps shown in FIGS. 3*a*-3*d*, creating a neck roll-receiving pocket 56 therein (see FIG. 3*c*). As seen in FIG. 3*a*, fabric panel 13 is generally rectangular and a side edge section 51 of side 13*b* thereof is defined between side edge 14*a* and fold line 16. Inwardly of side edge section 51 is another side section 53 defined between fold line 16 and phantom line 17.

Figure 3D:
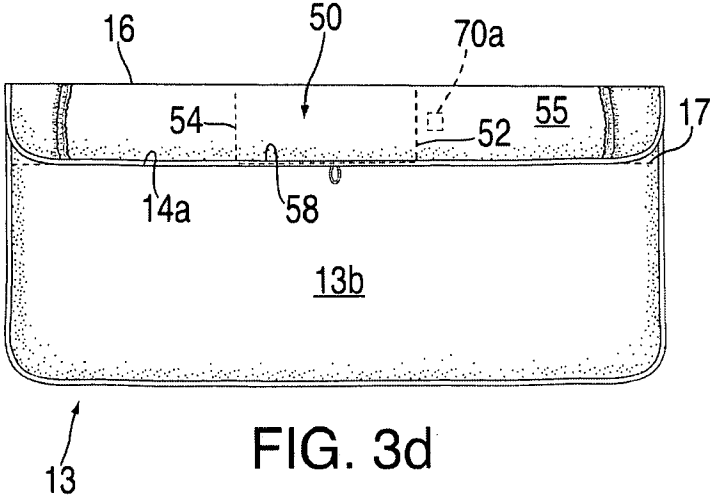

As shown in FIG. 3*b*, side edge 14*a* and, in turn, side edge section 51 are folded towards phantom line 17 and side section 53, respectively, along fold line 16, so that the side edge 14*a* engages side section 53 along phantom line 17, as seen in FIG. 3*c*. In this position, a side edge section 55 of panel 13*a* (opposite to section 51 of panel 13*b*) is folded over panel side 13*b*. As seen in FIG. 3*d*, the center portion of side edge section 55 is stitched to side 13*b* of the fabric panel 13 along stitch lines 54 and 58 and is left unattached along phantom line 52, to form the elongated tubular sleeve 50. The elongated tubular sleeve 50 has an open end along phantom line 52 and a closed end along stitch line 54, thereby forming the neck roll-receiving pocket 56 (FIG. 3*c*). It can be appreciated that the position of the open and closed ends, as well as the side of the fabric panel forming the elongated tubular sleeve, can be reversed.

Neck roll 20 (shown in phantom line in FIG. 4) is removably disposed in the neck roll-receiving pocket 56 by inserting and removing it via open end 52 of the tubular sleeve 50. Preferably, the neck roll receiving pocket 56 has a length slightly greater than the length of the neck roll 20.

The neck roll 20 is secured within the neck roll receiving pocket 56 by Velcro® hook and loop fasteners 70*a* and 70*b*, which are stitched adjacent the open end 52 of the elongated tubular sleeve 50. FIG. 3*a* shows hook and loop fastener 70*a* secured to side edge portion 51 and hook and loop fastener 70*b* secured to side portion 53 opposite of fold line 16 from fastener 70*a*, so that when the side edge 14*a* is folded towards phantom line 17, the hook and loop fasteners 70*a* and 70*b* are disposed on opposite sides of the elongated tubular sleeve 50 for mating, in order to secure the neck roll 20 within the neck roll-receiving pocket 56. It can be appreciated that other mechanical fastening means, such as a button and buttonhole, can also be used.

Neck roll 20 is provided to support the person's head and neck at a preferred angle to provide comfort to the person and enable them to rest and/or sleep more comfortably. The neck roll can be removed from the neck roll-receiving pocket so that the fabric panel and pouch can be washed without damaging the neck roll.

Figure 4:
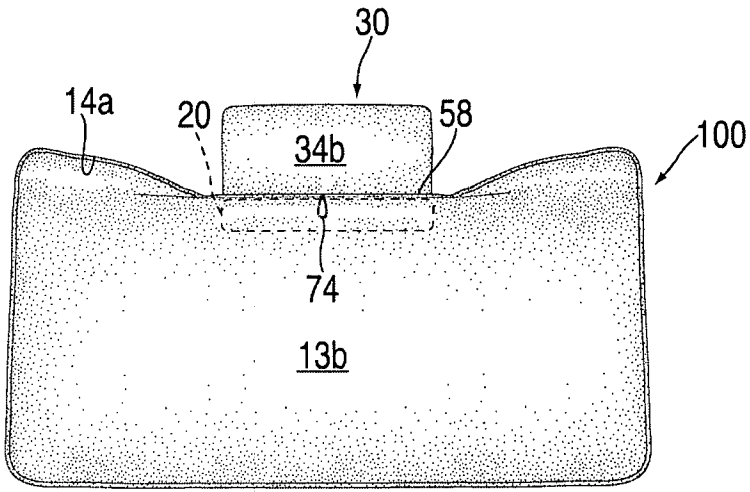
FIG. 4 is a rear elevational view of the assembly, further showing the hidden position of the neck roll in phantom line.

FIG. 4 illustrates the rear view of fully assembled, assembly 100 with side edge 14*a* extending fully outwardly and neck roll 20 shown in phantom line. Fabric panel 13 is gathered in the area adjacent the neck roll 20 and side edge 14*a* due to the formation of the neck roll-receiving pocket by manipulation and stitching of the fabric panel 13 itself, as described in relation to FIGS. 3*a*-3*d*. Due to the gathering adjacent the neck roll, opening 52 of the tubular sleeve 50 is hidden and not normally visible.

Figure 5:
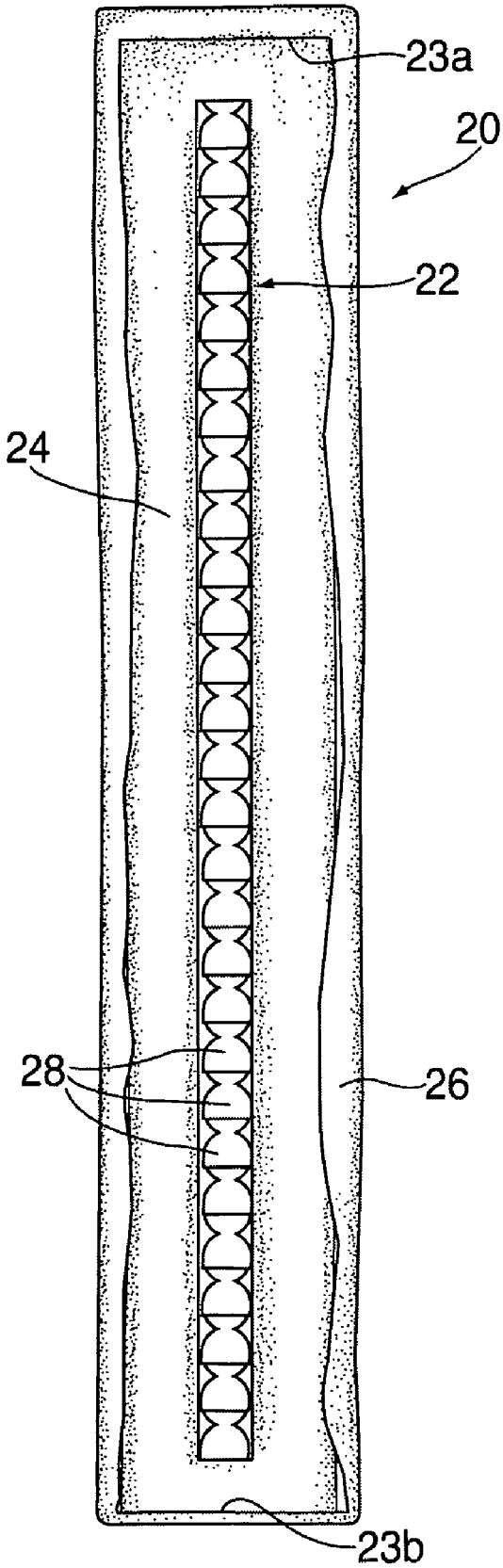
FIG. 5 is a longitudinal, partially cut away, elevational view illustrating the major components of the flexible neck roll.
Figure 6:
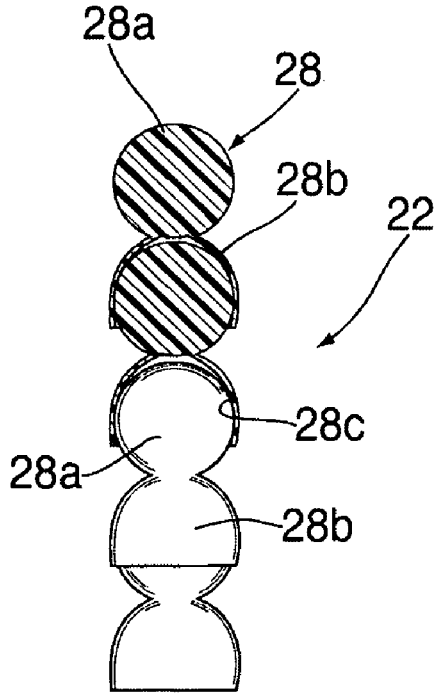
FIG. 6 is a side elevational view, in part section, of a portion of the modular ball and socket spine of the neck roll.

Turning now to FIGS. 5 and 6, the flexible and resilient neck roll 20, which is inserted into tubular sleeve 50, includes an articulated ball and socket modular plastic spine, generally designated by reference numeral 22 which allows the neck roll 20 to be bent into a desired shape and retain the bent shape. Spine 22 is received within a preferably compressible continuous foam tube 24 which surrounds and encases the entire spine 22. The spine 22 extends axially, substantially the entire length of the tube, but is spaced inwardly from the ends 23*a* and 23*b* of the foam tube 24. The foam tube 24 has a sleeve 26 covering it and is preferably made of a fabric material, but can be made from other materials.

Spine 22 is preferably made from a multiplicity of successively arranged relatively, rigid, plastic modular units 28 which are joined to one another via ball and socket joints. Each unit 28 has a substantially spherical ball portion 28*a* and a substantially hemispherical socket portion 28*b* which defines an interior space, i.e., 28*c* which is adapted to snugly receive a ball portion 28*a* of the adjacent unit 28. Preferably, ball portion 28*a* and socket 28*b* are joined directly together without any spacing between them to maximize the number of joints provided on the spine to provide the greatest versatility and flexibility.

Modular spine 22 is preferably made of a relatively hard durable plastic which is not easily damaged by the friction between the ball and socket portions when the spine is articulated into a shape desired by the person. It should be appreciated that the frictional engagement between modular units 28 of spine 22 allows the neck roll to be bent and maintained (i.e., self-supported) in the bent or folded configuration such as shown in FIG. 7, or a straightened configuration such as shown in FIG. 5, or in almost any other curved configuration, by manual manipulation of the neck roll 20, and in turn, said spine 22 thereof into the desired bent position.

Figure 7:
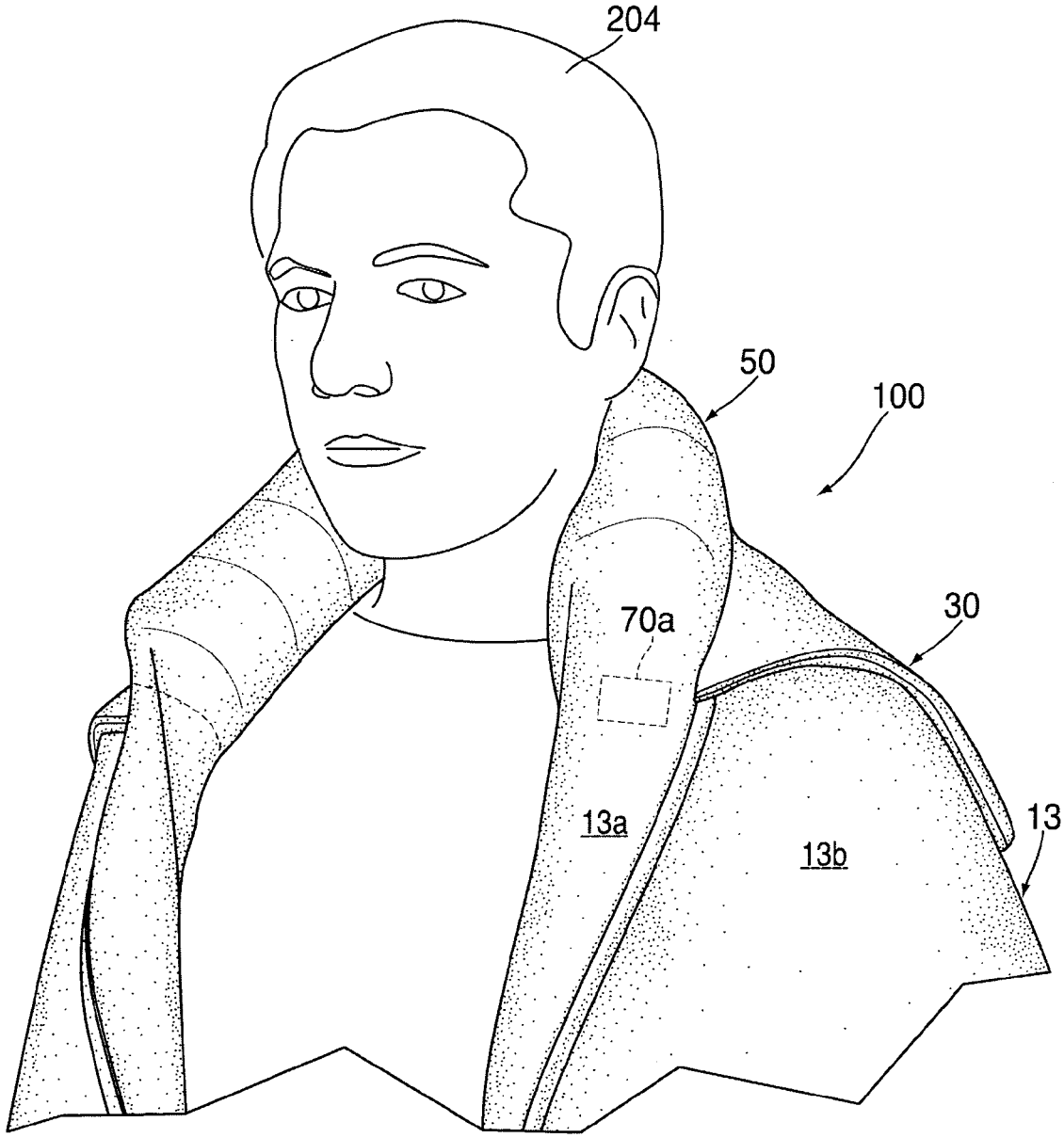
FIG. 7 is a fragmentarily-illustrated, perspective view of the assembly shown with the fabric panel and pouch draped over a person and the flexible neck roll wrapped around the person's neck.

Turning to FIG. 7, the articulated spine 22 allows the neck roll 20 to be manipulated into a bent configuration and self-supported on the person's body, such as around one's neck, shown in FIG. 7, to provide head and neck support on the back and sides of the person's neck. The assembly can be self-supported and provide head and neck support without requiring a seat back to support the neck roll in relation to the person. However, the neck roll 20 can be placed around other body parts of the person, such as a person's arm or waist.

The person can manually manipulate the neck roll around their neck to provide support for their head and neck and drape fabric panel 13 around themselves for comfort and warmth. It can be appreciated that the fabric panel can be held around the person by bending of neck roll 20 which will retain its bent shape. Tube 24 is readily compressible to provide a more comfortable fit to support one's neck and head so that the person does not feel the hard plastic spine.

Most advantageously, the neck roll is twenty one inches long and three inches in diameter to fit comfortably around a person's neck to retain one's head in a comfortable preferred orientation. Although, it will be appreciated that the device can be made smaller or larger.

Figure 9:
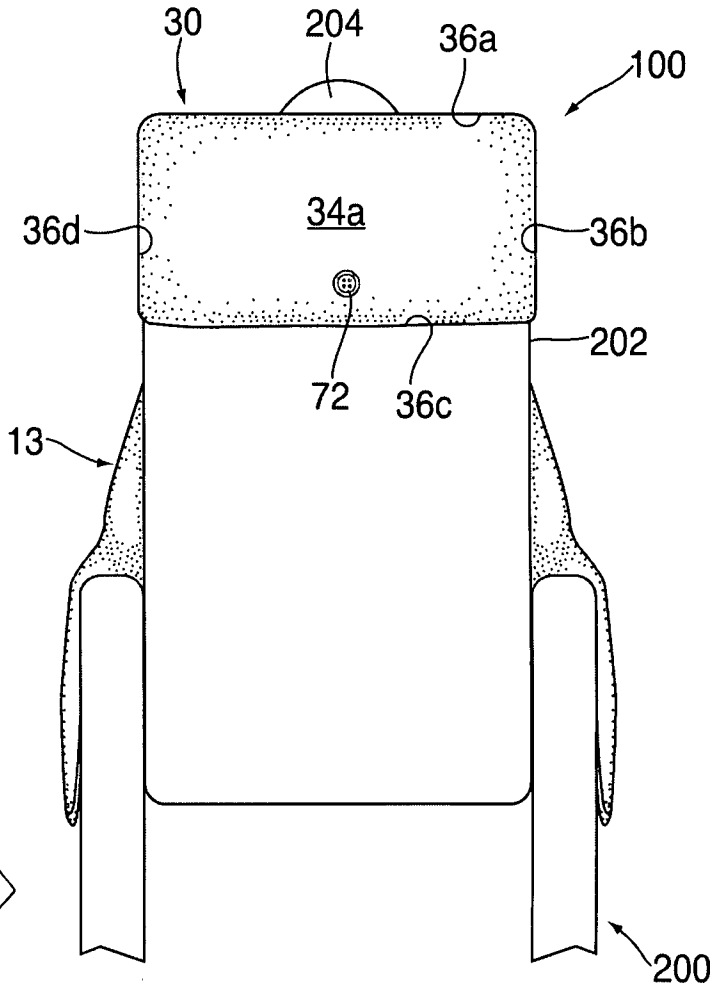
FIG. 9 is a rear elevational view of the assembly supported on a seat.
Figure 8:
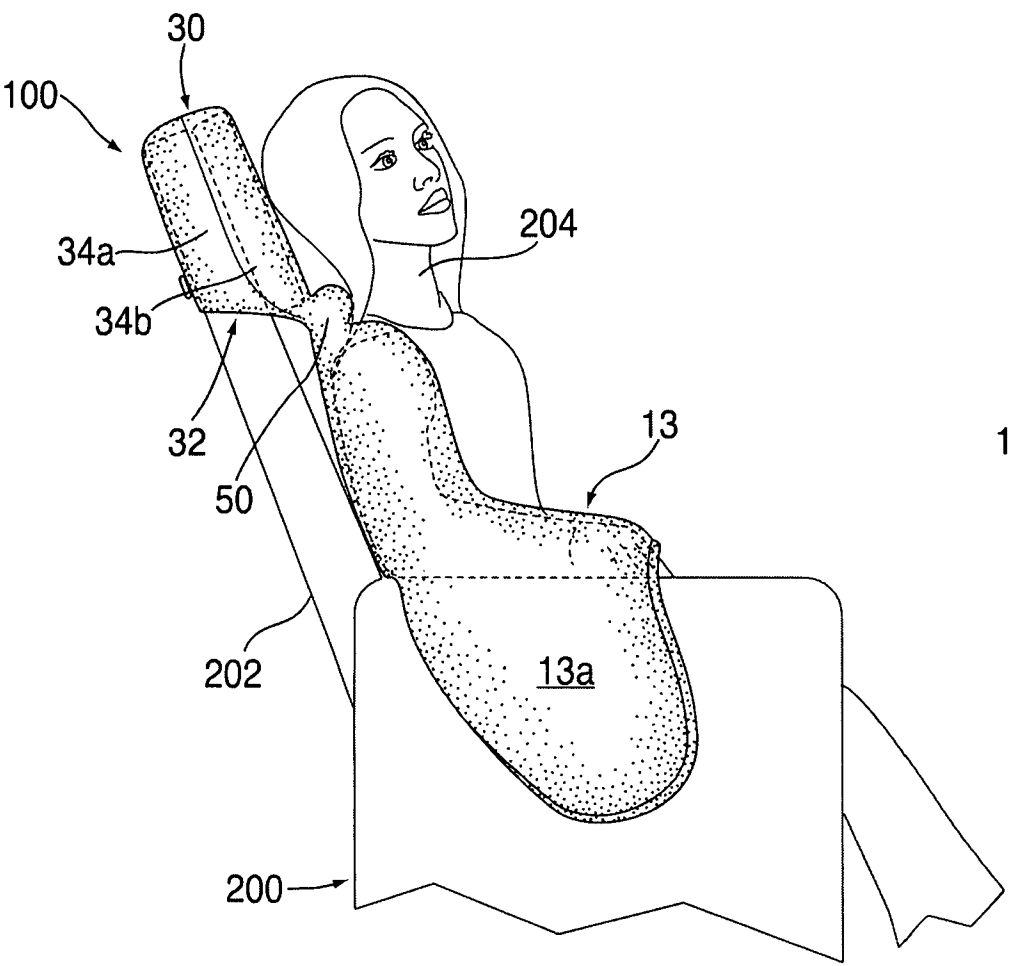
FIG. 8 is a side elevational view of the assembly supported on a seat.

Turning to FIGS. 8-9, the pouch 30 has a single opening 32 and is attached to side edge 14*a* of the fabric panel 13, adjacent neck roll 20. Opening 32 opens towards side 13*a* of fabric panel 13. More particularly, pouch 30 comprises two flat generally rectangular sheets 34*a* and 34*b* each having a top edge 36*a*, a bottom edge 36*c* and two opposite side edges 36*b* and 36*d*. The sheets 34*a* and 34*b* are attached via stitching to each other along their respective top edges 36*a* and side edges 36*b* and 36*d*. The sheets are unattached along the bottom edge 36*c* to define the pouch opening 32. The bottom edge 36*c* of sheet 34*b* is attached to fabric panel 13, adjacent to the neck roll 20 along stitching line 58, shown in FIG. 4. Pouch 30 can lie flat behind the person as shown in FIG. 7, or can be supported on the seat back 202, as shown in FIGS. 8-9.

Seat 200 is preferably an airline seat, but it can be appreciated that it can also be supported on many different types of seats. The opening 32 of pouch 30 is received over and atop of the seat back 202, so that the fabric panel 13 overlies the seat and a person can sit upon the fabric panel and wrap it around themself to provide comfort and warmth. When the pouch 30 is supported over the seat back 202, the neck roll 20 is positioned at least partially against the seat back 202, behind the person's neck to provide support for their neck and head and retain them in a preferred angle, allowing the person to rest and/or sleep more comfortably. Placement of the assembly 100 over and atop of the seat back 202 retains the neck roll 20 and fabric panel 13 in a secured position in relation to the person so that the assembly will not shift due to movement of the aircraft or other vehicle, or movement of the person while resting or sleeping.

Figure 10A:
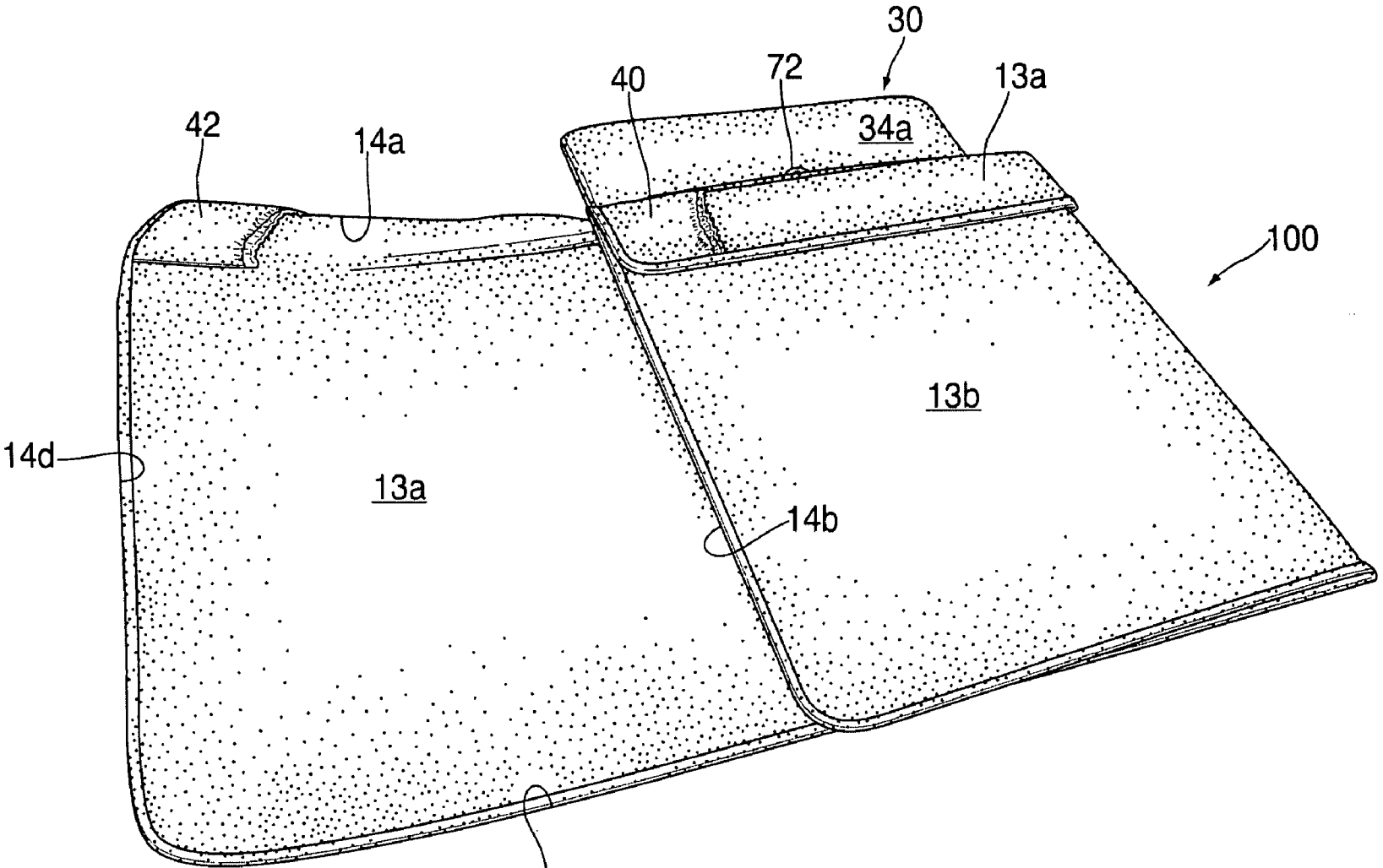
FIGS. 10*a*-10*f* are perspective views showing the preferred steps of folding the fabric panel and neck roll into its folded stored position within the attached pouch.
Figure 10B:
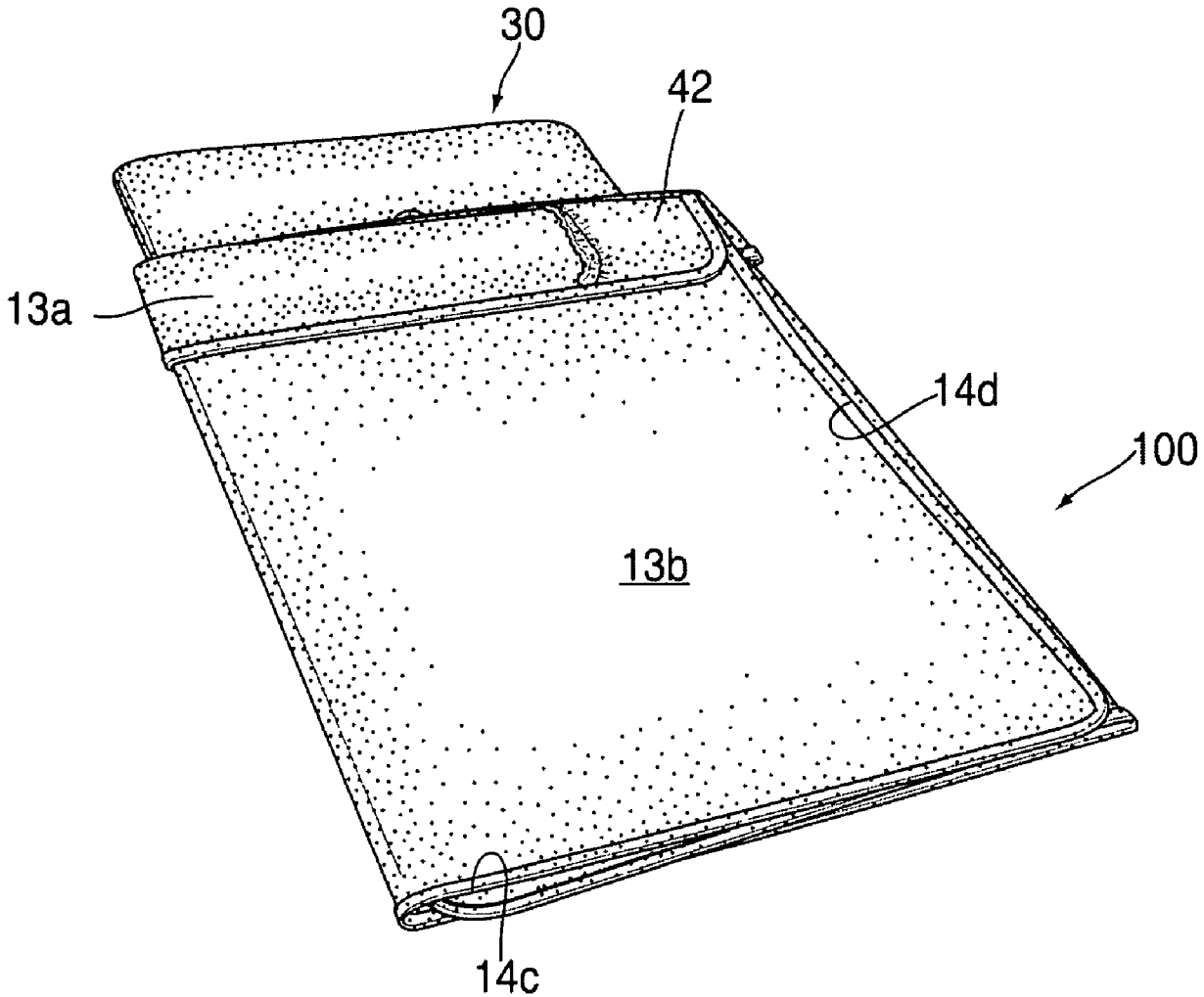
Figure 10D:
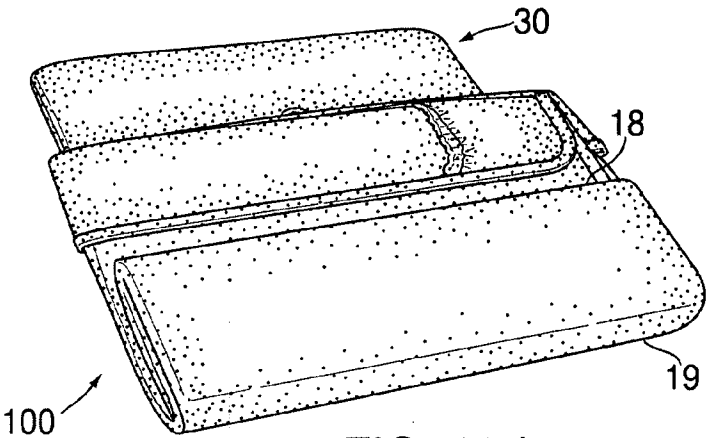
Figure 10C:
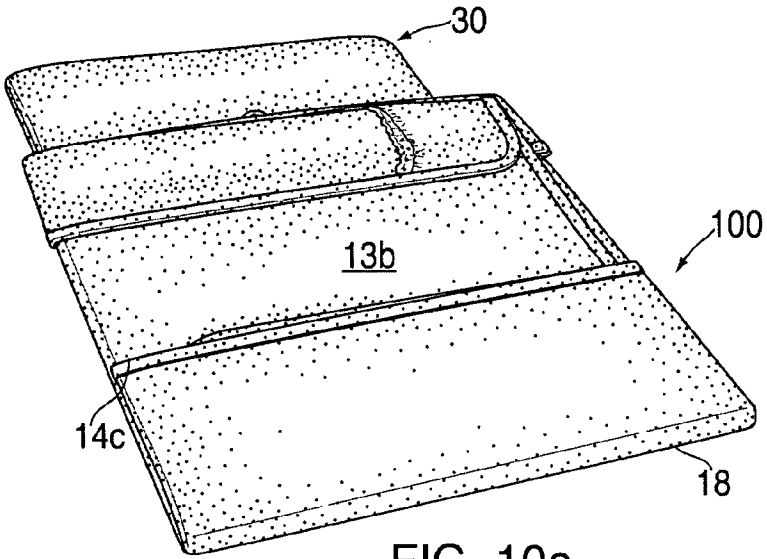
Figure 10F:
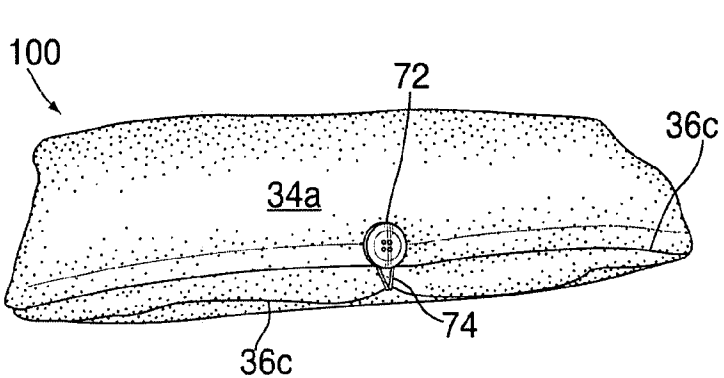

Turning to FIGS. 10*a* through 10*f*, the fabric panel 13 and neck roll 20 are self-storing within pouch 30 and are movable from an open position, as illustrated in FIG. 1, in which the fabric panel and neck roll are disposed exteriorly of said pouch, to a folded stored position within pouch 30, illustrated in FIG. 10*f*, for easier and more compact transportation and storage of the assembly 100.

Figure 10E:
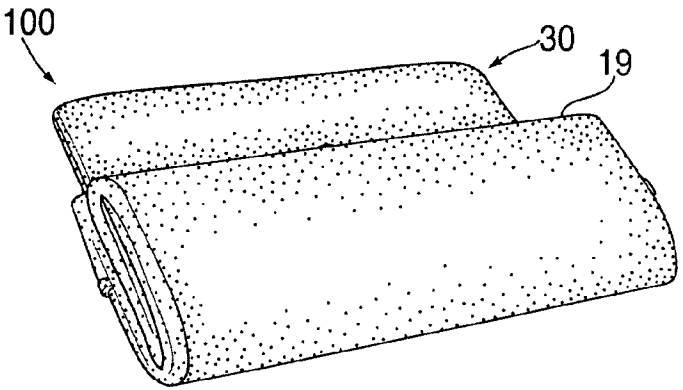

FIGS. 10*a*-10*f* show the preferable steps for folding the fabric panel 13 and neck roll 20 into its folded stored position within pouch 30. In particular, in step 1 shown in FIG. 10*a*, side edge 14*b* is folded towards side 13*a* of the fabric panel 13 and overlaps a portion of side 13*a*. In step 2 shown in FIG. 10*b*, side edge 14*d* is folded towards and overlaps the folded portion from step 1. In step 3 shown in FIG. 10*c*, side edge 14*c* is folded towards the pouch and overlaps a portion of the folded panel from step 2, forming bottom folded edge 18. Bottom folded edge 18 is folded towards the pouch 30 overlapping the previous folds and forming a second bottom folded edge 19, which is then folded towards the pouch as shown in FIG. 10*e* and overlaps the previous folds. Neck roll 20 and fabric panel 13 are then inserted into opening 32 of pouch 30 to form the folded stored position, shown in FIG. 10*f*, without having to invert the pouch over the fabric panel and neck roll. When in the folded stored position in FIG. 10*f*, the assembly 100 according to the invention can also be used as a pillow or lumbar support for the person. It can be appreciated that there are other procedures for folding and storing the assembly within the pouch.

A button 72 is attached to sheet 34*a* of the pouch adjacent to the pouch opening 32 and a loop is attached adjacent to sheet 34*b*, opposite therefrom. Button 72 and loop 74 are provided to mechanically fasten the fabric panel 13 and neck roll 20 in the folded stored position by inserting button 72 through loop 74, as shown in FIG. 10*f*. However, it can be appreciated that other means to secure the assembly in its closed position can be used, for example, a loop and toggle closure.

Figure 11:
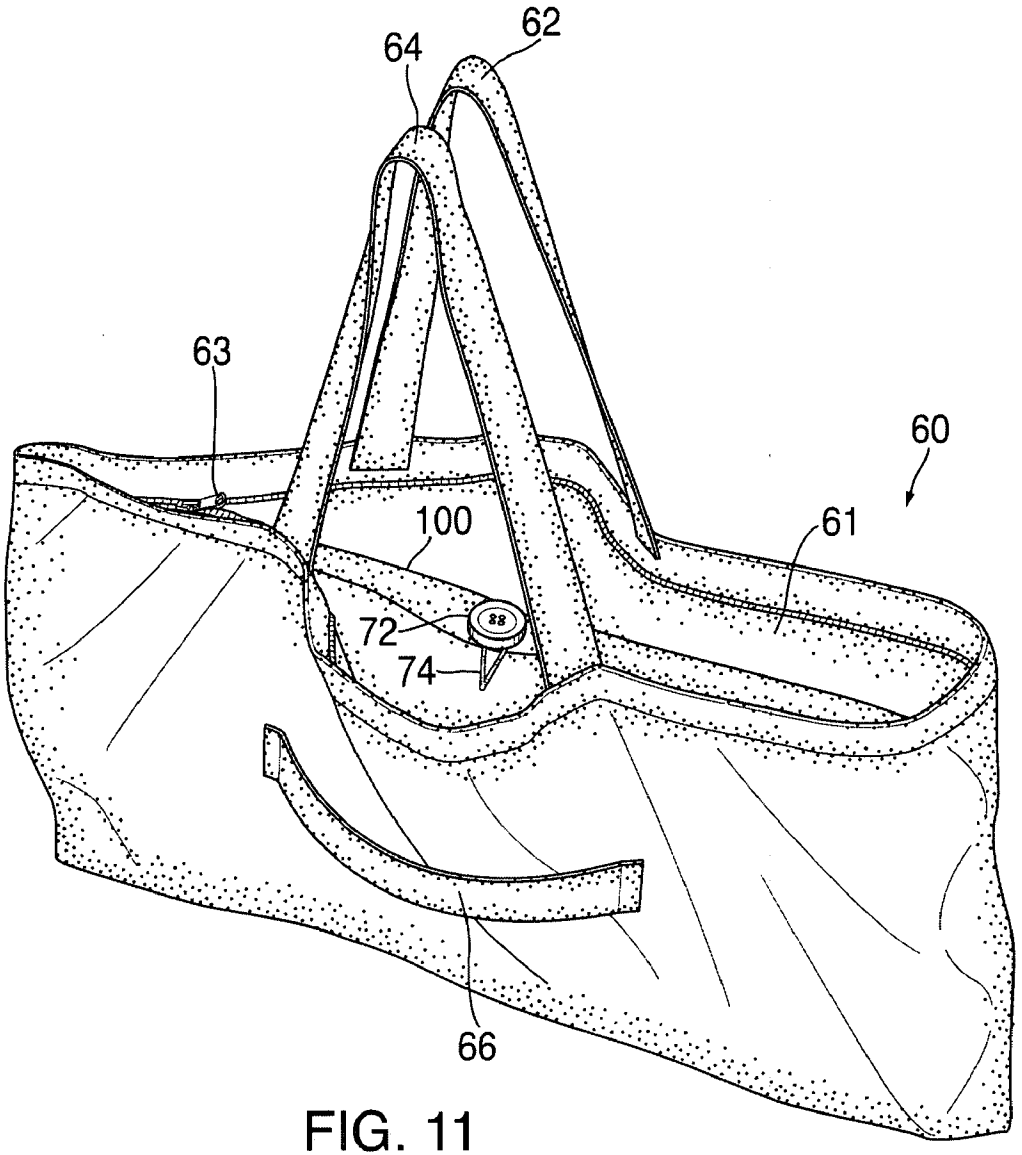
FIG. 11 is a perspective view of the assembly in the folded stored position within the attached pouch and placed within the carrying case, with the zipper opened.
Figure 12:
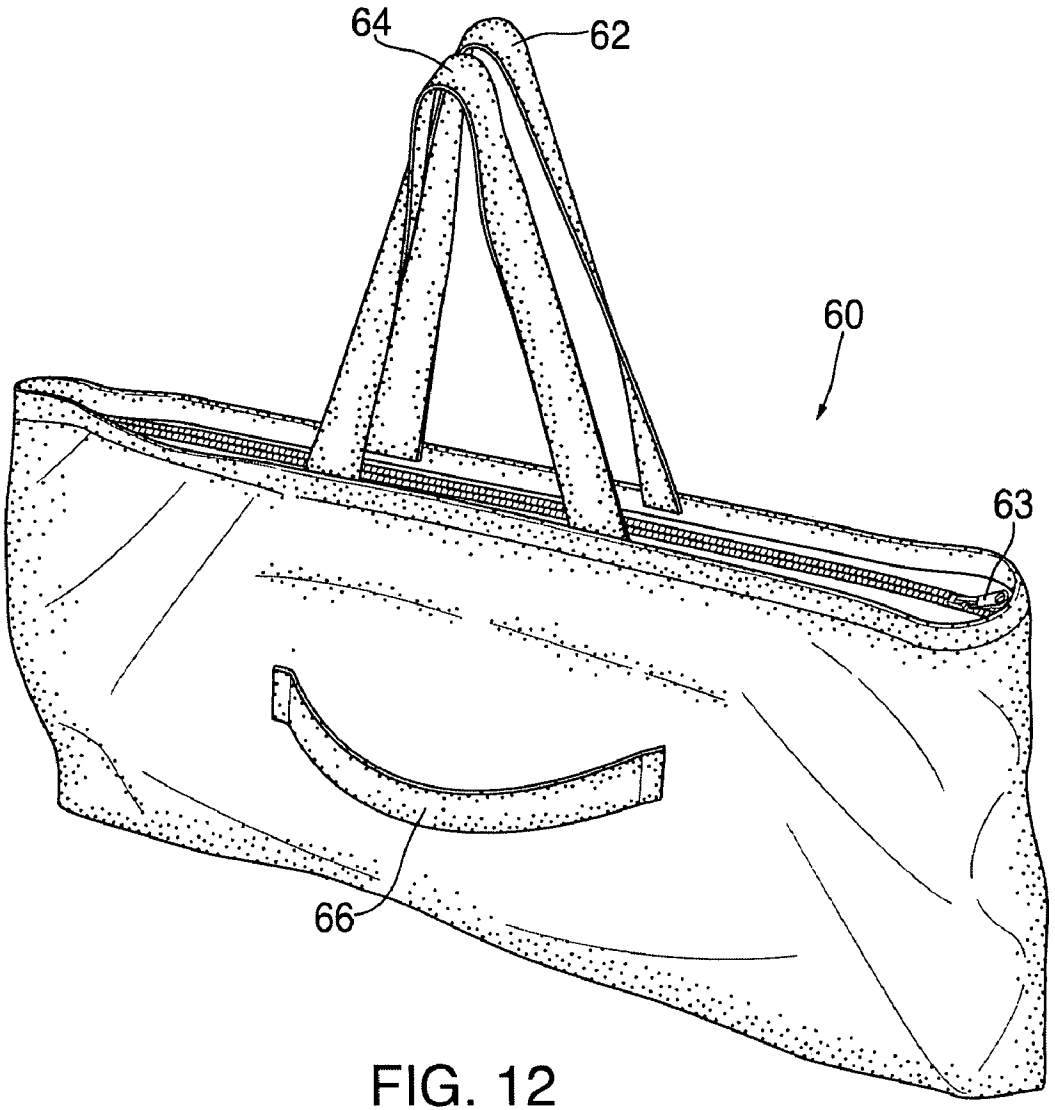
FIG. 12 is a perspective view of the assembly in a folded stored position within the attached pouch and placed within the carrying case, with the zipper closed.

FIGS. 11 and 12 illustrate a carrying case generally designated by reference numeral 60 which has an opening 61, top handles 62, 64, and side handle 66. Carrying case 60 is also provided with a zipper 63. Assembly 100 can be inserted within opening 61 of carrying case 60 for transportation and storage and to keep the assembly clean and sanitary when not in use. Zipper 63 is provided to maintain the assembly 100 within the carrying case. The carrying case is preferably made of a nylon fabric but can also be constructed from other materials.

There have been described and illustrated herein a self-storing combination blanket and neck roll assembly. While particular embodiments of the invention have been described, it is not intended that the invention be limited thereto, as it is intended that the invention will be as broad in scope as the art will allow and that the specification be read likewise. For example, although the plastic spine 22 is embedded within the foam tube, it can be provided with another tube surrounding the spine within the foam tube to prevent the person from feeling the hard plastic spine when grasping and bending the assembly. (See, for example, my prior U.S. Pat. No. 6,929,612, the subject matter of which is incorporated herein by reference thereto). Furthermore, the foam tube can be made from a visco elastic memory foam or other type of compressible material. The neck roll can also contain a vibration device, similar to that disclosed in my prior patent.

In addition, while the articulation of the spine by the ball and socket arrangement is highly advantageous, articulation by other bendable techniques which permit repeated handling and bending without breaking or rupture may be possible. Similarly, while the spine is preferably made of plastic, it could also be made of metal.

Fabric panel 13 is preferably made from two sheets of fabric material which can be stitched together along the side edges, but can be made from a single sheet of fabric. Furthermore, the fabric can be the same on each side of the fabric panel but can also be made of different materials so that the person can choose between the sides to wrap around themselves and a variety of fabrics could be utilized such as fleece fabric on one side and micro fiber fabric on the other. The fabric panel can also be constructed from a plurality of laminate plies.

Additionally, the assembly when in its folded stored position can be placed behind a person's back for lumbar support while working or traveling. The assembly can also serve as a decorative pillow.

It will therefore be appreciated by those skilled in the art that other modifications could be made to the provided invention without deviating from its spirit and scope as so claimed.

What is claimed is:

1. A self-storing combination blanket and neck roll assembly which can be draped over a person and supported on a seat having a back, comprising:

a flat, generally rectangular fabric panel having two sides and four side edges;

a flexible neck roll centrally located and removably disposed adjacent to a portion of said fabric panel disposed adjacent to one of said side edges of said fabric panel wherein said neck roll is bendable into a desired bent shape and has means for retaining said bent shape comprising a flexible spine disposed within said neck roll;

a pouch having an opening, said pouch being attached to said one side edge of said fabric panel adjacent to said neck roll so that said opening thereof opens towards one of said sides of said fabric panel and having two flat, generally rectangular sheets each having a top edge, a bottom edge, and two opposite side edges, wherein said sheets are attached to each other along said top edges and said two side edges thereof and unattached along said bottom edges thereof to define said pouch opening and wherein said bottom edge of one of said sheets is attached to said one side edge of said fabric panel adjacent to said neck roll-receiving pocket and wherein said pouch is configured and dimensioned to permit both said fabric panel and said neck roll to be folded and received therein;

an elongated tubular sleeve having two ends, one of which is open and the other of which is closed, thereby forming a neck roll-receiving pocket, said sleeve and, in turn, said pocket disposed adjacent to a portion of said fabric panel adjacent to said opening of said pouch and wherein said neck roll is removably disposed in said neck roll-receiving pocket; and wherein said fabric panel and said neck roll received in said neck roll-receiving pocket are movable between a folded stored position wherein said fabric panel and said neck roll received in said neck roll-receiving pocket, are stored within said pouch and an open position wherein said fabric panel and said neck roll received in said neck roll-receiving pocket, are disposed exteriorly of said pouch and wherein, when in said open position, said opening of said pouch can be received over and atop of the seat back.

2. The assembly according to claim 1, wherein:

said seat is an airline seat.

3. The assembly according to claim 1, wherein:

one of said sides of said fabric panel defines a side edge portion thereof extending along and adjacent to, and merging with, said one of said side edges of said fabric panel and wherein a generally rectangular central section of said side edge portion is folded towards said at least one side of said fabric panel to define a flap having a flap edge coincident with and defined by said one side edge of said fabric panel and two flap ends, wherein said flap edge and one of said flap ends is attached to said fabric panel to form said elongated tubular sleeve from said fabric panel itself.

4. The assembly according to claim 1, further comprising:

means for removably securing said neck roll within said neck roll-receiving pocket.

5. The assembly according to claim 4, wherein:

said means for removably securing said neck roll within said neck roll-receiving pocket comprises a pair of hook and loop fasteners disposed adjacent to said open end of said elongated tubular sleeve, one of which fasteners is secured to said flap and the other of which is secured to said fabric panel opposite therefrom.

6. The assembly according to claim 1, wherein:

said four side edges of said fabric panel define four corners of said fabric panel, and wherein the two corners closest to said neck roll are each provided with an accessory pocket.

7. The assembly according to claim 1, wherein:

said neck roll is made of a resilient material.

8. The assembly according to claim 1, wherein:

said neck roll-receiving pocket has a length which is slightly greater than the length of said neck roll.

9. The assembly according to claim 1, wherein:

the length of said neck roll is less than the length of said pouch.

10. The assembly according to claim 1, wherein:

said neck roll comprises a tube and said flexible spine is an articulated spine extending axially along the majority of said tube, said spine comprising a multiplicity of successively-arranged, jointed rigid elements which are movable relative to one another by manual manipulation of said neck roll and, in turn, said spine thereof, to effect bending of said neck roll.

11. The assembly according to claim 10, wherein:

said rigid elements are each joined to adjacent rigid elements by a ball and socket joint.

12. The assembly according to claim 10, wherein:

said articulated spine is plastic.

13. The assembly according to claim 10, wherein:

said articulated spine extends substantially the entire length of said tube but is spaced from the ends thereof.

14. The assembly according to claim 10, wherein:

said tube is made of a foam material.

15. The assembly according to claim 14, wherein:

said foam tube is continuous and encases the entire length of said spine.

16. The assembly according to claim 14, further comprising:

a sleeve covering said tube.

17. The assembly according to claim 1, wherein:

said means for removably securing said fabric panel and said neck roll in said folded stored position within said pouch is a mechanical fastener comprising a button and a loop, one of which is attached to one of said two sheets of said pouch adjacent said pouch opening and the other of which is attached adjacent to the other of said sheets opposite therefrom.

18. The assembly according to claim 1, further comprising:

means for removably securing said fabric panel and said neck roll in said folded stored position within said pouch.

19. A self-storing combination blanket and neck roll assembly which can be draped over a person and supported on a seat having a back, comprising:

a flat, generally rectangular fabric panel having two sides and four side edges;

a flexible neck roll centrally located and removably disposed adjacent to a portion of said fabric panel disposed adjacent to one of said side edges of said fabric panel wherein said neck roll is bendable into a desired bent shape and has means for retaining said bent shape comprising a flexible spine disposed within said neck roll;

a pouch having an opening, said pouch being attached to said one side edge of said fabric panel adjacent to said neck roll so that said opening thereof opens towards one of said sides of said fabric panel and wherein said pouch is configured and dimensioned to permit both said fabric panel and said neck roll to be folded and received therein; and an elongated tubular sleeve having two ends, forming a neck roll-receiving pocket, said sleeve and, in turn, said pocket disposed adjacent to a portion of said fabric panel adjacent to said opening of said pouch and wherein said neck roll is removably disposed in said neck roll-receiving pocket;

wherein one of said sides of said fabric panel defines a side edge portion thereof extending along and adjacent to, and merging with, said one of said side edges of said fabric panel and wherein a generally rectangular central section of said side edge portion is folded towards said at least one side of said fabric panel to define a flap having a flap edge coincident with and defined by said one side edge of said fabric panel and two flap ends, wherein said flap edge and one of said flap ends is attached to said fabric panel to form said elongated tubular sleeve from said fabric panel itself; and wherein said fabric panel and said neck roll received in said neck roll-receiving pocket are movable between a folded stored position wherein said fabric panel and said neck roll received in said neck roll-receiving pocket, are stored within said pouch and an open position wherein said fabric panel and said neck roll received in said neck roll-receiving pocket, are disposed exteriorly of said pouch and wherein, when in said open position, said opening of said pouch can be received over and atop of the seat back.

20. The assembly according to claim 19, wherein:

one of said ends of said elongated tubular sleeve is open and the other is closed.

21. The assembly according to claim 19, further comprising:

means for removably securing said neck roll within said neck roll-receiving pocket.

22. The assembly according to claim 19, wherein:

said means for removably securing said neck roll within said neck roll-receiving pocket comprises a pair of hook and loop fasteners disposed adjacent to said open end of said elongated tubular sleeve, one of which fasteners is secured to said flap and the other of which is secured to said fabric panel opposite therefrom.

23. The assembly according to claim 19, wherein:

said four side edges of said fabric panel define four corners of said fabric panel, and wherein the two corners closest to said neck roll are each provided with an accessory pocket.

24. The assembly according to claim 19, wherein:

said neck roll is made of a resilient material.

25. The assembly according to claim 19, wherein:

said neck roll comprises a tube and said flexible spine is an articulated spine extending axially along the majority of said tube, said spine comprising a multiplicity of successively-arranged, jointed rigid elements which are movable relative to one another by manual manipulation of said neck roll and, in turn, said spine thereof, to effect bending of said neck roll.

26. The assembly according to claim 19, wherein:

said rigid elements are each joined to adjacent rigid elements by a ball and socket joint.

27. The assembly according to claim 19, wherein:

said articulated spine is plastic.

28. The assembly according to claim 19, wherein:

said articulated spine extends substantially the entire length of said tube but is spaced from the ends thereof.

29. The assembly according to claim 19, wherein:

said tube is made of a foam material.

30. The assembly according to claim 19, wherein:

said foam tube is continuous and encases the entire length of said spine.

31. The assembly according to claim 19, further comprising:

a sleeve covering said tube.

32. The assembly according to claim 19, wherein:

said pouch comprises two flat, generally rectangular sheets each having a top edge, a bottom edge, and two opposite side edges, wherein said sheets are attached to each other along said top edges and said two side edges thereof and unattached along said bottom edges thereof to define said pouch opening and wherein said bottom edge of one of said sheets is attached to said one side edge of said fabric panel adjacent to said neck roll-receiving pocket.

33. The assembly according to claim 19, further comprising:

means for removably securing said fabric panel and said neck roll in said folded stored position within said pouch.

34. The assembly according to claim 19, wherein:

said means for removably securing said fabric panel and said neck roll in said folded stored position within said pouch is a mechanical fastener comprising a button and a loop, one of which is attached to one of said two sheets of said pouch adjacent said pouch opening and the other of which is attached adjacent to the other of said sheets opposite therefrom.

35. The assembly according to claim 19, wherein:

the length of said neck roll is less than the length of said pouch.

36. The assembly according to claim 19, wherein:

said neck roll-receiving pocket has a length which is slightly greater than the length of said neck roll.

37. The assembly according to claim 19, wherein:

said seat is an airline seat.

* * * * *